US009027368B2

(12) United States Patent
Ji et al.

(10) Patent No.: US 9,027,368 B2
(45) Date of Patent: May 12, 2015

(54) LAUNDRY MACHINE HAVING A STEAM GENERATOR AND CONTROLLING METHOD OF THE SAME

(75) Inventors: Yoo Chol Ji, Seoul (KR); Kyung Ah Choi, Seoul (KR); Yun Mi Park, Seoul (KR); Ji Young Park, Seoul (KR); Mi Son Ahn, Seoul (KR)

(73) Assignee: LG Electronics Inc., Seoul (KR)

( * ) Notice: Subject to any disclaimer, the term of this patent is extended or adjusted under 35 U.S.C. 154(b) by 1152 days.

(21) Appl. No.: 12/863,423

(22) PCT Filed: Jan. 13, 2009

(86) PCT No.: PCT/KR2009/000169

§ 371 (c)(1),
(2), (4) Date: Feb. 22, 2011

(87) PCT Pub. No.: WO2009/091169

PCT Pub. Date: Jul. 23, 2009

(65) Prior Publication Data

US 2011/0138542 A1 Jun. 16, 2011

(30) Foreign Application Priority Data

Jan. 18, 2008 (KR) ..... 10-2008-0005637

(51) Int. Cl.
*D06F 39/04* (2006.01)
*D06F 39/00* (2006.01)
*D06F 58/20* (2006.01)

(52) U.S. Cl.
CPC ..... *D06F 39/008* (2013.01); *D06F 58/203* (2013.01)

(58) Field of Classification Search
CPC ..... D06F 39/008; D06F 58/203
USPC ..... 68/5 R, 5 C, 12.01, 12.04, 12.05, 12.23, 68/15
See application file for complete search history.

(56) References Cited

U.S. PATENT DOCUMENTS

| | | | | |
|---|---|---|---|---|
| 1,950,511 | A * | 3/1934 | Noll | 392/328 |
| 2009/0056389 | A1 * | 3/2009 | Pinkowski et al. | 68/5 C |
| 2011/0132043 | A1 * | 6/2011 | Kim | 68/5 R |

FOREIGN PATENT DOCUMENTS

| | | | | |
|---|---|---|---|---|
| EP | 1852533 | | 11/2007 | |
| JP | 02239894 | A * | 9/1990 | D06F 35/00 |
| KR | 20-1993-0019820 | U | 9/1993 | |
| KR | 10-0531327 | B1 | 11/2005 | |
| KR | 10-2007-0028055 | A | 3/2007 | |
| KR | 10-2007-0121970 | A | 12/2007 | |
| WO | WO 2006/098571 | | 9/2006 | |
| WO | WO 2006/101345 | | 9/2006 | |
| WO | WO 2006129915 | A1 * | 12/2006 | |
| WO | WO 2007/026989 | | 3/2007 | |
| WO | WO 2007148894 | A3 * | 2/2008 | |

* cited by examiner

*Primary Examiner* — Joseph L Perrin
(74) *Attorney, Agent, or Firm* — McKenna Long & Aldridge LLP

(57) ABSTRACT

A laundry machine having a steam generator is disclosed. An embodiment of a laundry machine comprises a drum, a steam generator, and a controller. The steam generator may include a heat-variable heater. The heater may be operated in one setting among a plurality of heat settings.

17 Claims, 6 Drawing Sheets

LAUNDRY MACHINE HAVING A STEAM GENERATOR AND CONTROLLING METHOD OF THE SAME

TECHNICAL FIELD

The disclosure relates to a laundry machine, and more particularly, to a laundry machine having a steam generator. The laundry machine may be a clothes treating machine, such as a washing machine, a drying machine, a washing-and-drying machine, or any other similar machine.

BACKGROUND ART

A washing machine may be classified as a drum type washing machine that uses lifters to lift and drop laundry in a drum to wash the laundry using a relatively small amount of water or as a pulsator type washing machine or an upright washing machine that supplies a large amount of water into a vertically installed drum and rotates the laundry to wash the laundry using friction generated by a stream of water.

A drying machine may be a home appliance that dries washed laundry using high-temperature air. Generally, the drying machine includes a drum for receiving clothes to be dried, a drive source for driving the drum, a heating unit for heating air to be introduced into the drum, and a blower unit for suctioning or discharging air into or out of the drum.

Based on how air is heated, i.e., the type of the heating unit, the drying machine may be classified as an electric drying machine or a gas drying machine. The electric drying machine typically heats air using electric resistance heaters, whereas the gas drying machine typically heats air using heat generated by the combustion of gas. In addition, the drying machine may be classified as a condensation type drying machine or an exhaust type drying machine. In the condensation type drying machine, air, heat-exchanged with clothes to be dried in a drum and changed into a high-humidity phase, is circulated without discharging the air out of the drying machine. Heat exchange is performed between an additional condenser and external air to produce condensed water, which is discharged out of the drying machine. In the exhaust type drying machine, air, heat-exchanged with clothes to be dried in a drum and changed into a high-humidity phase, is directly discharged out of the drying machine. Based on how laundry is placed in the drying machine, the drying machine may be classified as a top-loading type drying machine or a front-loading type drying machine. In the top-loading type drying machine, clothes to be dried are loaded from the top of the drying machine. In the front-loading type drying machine, clothes to be dried are loaded from the front of the drying machine.

In recent years, a steam washing machine or a steam drying machine has appeared as a laundry machine using steam. As the steam is used in the laundry machine, a washing performance is enhanced, and energy efficiency is greatly improved. Also, new functions are being added through the use of steam.

DISCLOSURE OF INVENTION

Technical Problem

In a conventional washing machine having a steam generator, the steam generator does not include a heat-variable heater. The steam was generated and supplied to a tub or a drum with a same rate.

Technical Solution

An embodiment of a laundry machine comprises a drum, a steam generator, and a controller. Laundry is placed in the drum and treated. The steam generator generates steam to be supplied to the drum. The steam may be supplied directly into the drum or supplied into a tub in which the drum is placed. Generally, washing machines comprise a tub for holding water therein, and a drum is placed inside of the tub. With the washing machines, when steam is supplied into the tub, the steam reaches the drum and part of the steam may flow in the drum.

The steam generator may include a heat-variable heater. The heater may be operated in one setting among a plurality of heat settings.

The controller may control the heater to be operated in the one heat setting. The heat setting may be determined according to an amount of steam to be supplied to the drum. In other words, the controller may control the heater to be operated in a heat setting according to an amount of steam to be supplied to the drum.

Further, the controller may control the heater to generate or supply steam to the drum in an amount per time. With the controlling of the heat-variable heater, steam may be generated or supplied to the drum in a greater or lower amount per time.

The amount of steam to be supplied to the drum may be determined according to at least one of a laundry course, a user's selection, and a total amount of steam determined to be supplied to the drum.

For instance, steam may be generated or supplied to the drum in a relatively greater amount for a certain laundry course than for another laundry course.

Also, a user may select an amount of steam to be supplied to the drum, and the controller may control the heater to be operated to generate steam according to the selected amount.

For the user's selection, a steam amount selector may be further included. A user may select an amount of steam through the steam amount selector. The steam amount selector may be configured to be one or a plurality of buttons or provided in a form of a touch screen. Further, the steam amount selector may be configured to allow a user to select one among a plurality of predetermined settings.

A total amount of steam to be supplied to the drum may be determined and the controller may control to operate the heater according to the determined total amount of steam. The total amount of steam may be determined according to an amount of laundry. The laundry amount may be determined through a sensor to sense an amount of laundry. Alternatively, the laundry amount may be determined by a user's selection. A laundry amount selector may be further included for the user's selection. For example, a user may select one among a plurality of predetermined settings for laundry amounts, then the controller may control to operate the heater in a corresponding heat setting to generate steam in the selected amount.

The laundry machine may further comprise a plurality of nozzles for giving off the steam to supply the steam to the drum. Further, the laundry machine may comprise at least one valve to open or close the passage towards one of the nozzles. The nozzles may be arranged at places predetermined distance apart from each other. The nozzle may be arranged at places to supply the steam in various directions. For example, one nozzle may be placed at a middle point of the drum, and another nozzle at a left point of the drum, and another nozzle at a right point of the drum. In a full mode for supplying steam, for example, all nozzles may be used.

The heater of the steam generator may a plurality of heating elements. In a full steam supply mode, for example, all of the heating elements may be operated, and in a lowest steam supply mode, only one heating element may be operated. Further, the heating elements may have different heating capacities from each other. With the different heating capacities, a number of heating modes can be achieved even a small number of heating elements.

Further, the laundry machine may include means for allowing a user to input a command for supplying steam to the tub or the drum at any time which he/she wants. The means may comprise a button, a touch panel, or other forms allowing the inputting of the command.

Whenever the user inputs the command through the means, the controller of the laundry machine may instantly response to the command. So, the controller controls the steam generator to be operated to supply steam to the tub or the drum.

The user may input the command at any time he/she wants, even during a laundry course being performed. For example, the user may input the command for the supplying of steam while a washing cycle, a rinsing cycle, or a spin-drying cycle is being performed.

Further, the laundry machine may include a displaying means for indicating that steam is being supplied to the tub or the drum. A user may easily recognize that steam is being discharged into the tub or the drum.

Further, the laundry machine may include a displaying means for indicating the generated or supplied amount of steam per time. The means may indicate a rate of the generation or supply of the steam. The amount of steam which is generated or supplied per time may differ according to the heat setting of the heater. The means may indicate the amount of steam per time.

The displaying means for the indications as above may comprises LED lamps or a LCD display.

An embodiment of a controlling method of a laundry machine comprises determining one setting in a plurality of heat settings for operating a heater of a steam generator and controlling to operate the heater with the determined setting to generate steam.

The determining of the one setting may be performed according to at least one of a laundry course, a user's selection, and a total amount of steam which is to be supplied to the drum.

It is to be understood that both the foregoing general description and the following detailed description are exemplary and explanatory and should not be construed as limiting the scope of any claim.

Advantageous Effects

According to the present invention, steam may be used efficiently and effectively according to corresponding conditions. Since the steam generation and supply per time is adjustable according to a condition of steam usage such as a type of a laundry course, etc., the steam can be used efficiently and effectively according to the corresponding condition.

Advantages, objects, and features of the invention will be set forth in part in the description which follows and in part will become apparent to those having ordinary skill in the art upon examination of the following or may be learned from practice of the invention. The other objectives and advantages of the invention may be realized and attained by the exemplary structures and/or methods particularly pointed out in the written description and claims hereof as well as the appended drawings.

BRIEF DESCRIPTION OF DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings:

Reference will now be made in detail to exemplary embodiments of the invention, which are illustrated in the accompanying drawings. Wherever possible, the same reference numbers will be used throughout the drawings to refer to the same or like parts.

FIG. 1 schematically illustrates a drum type laundry machine for washing as one example of the laundry machines. The laundry machine shown in FIG. 1 includes a steam generator.

Figure 1:
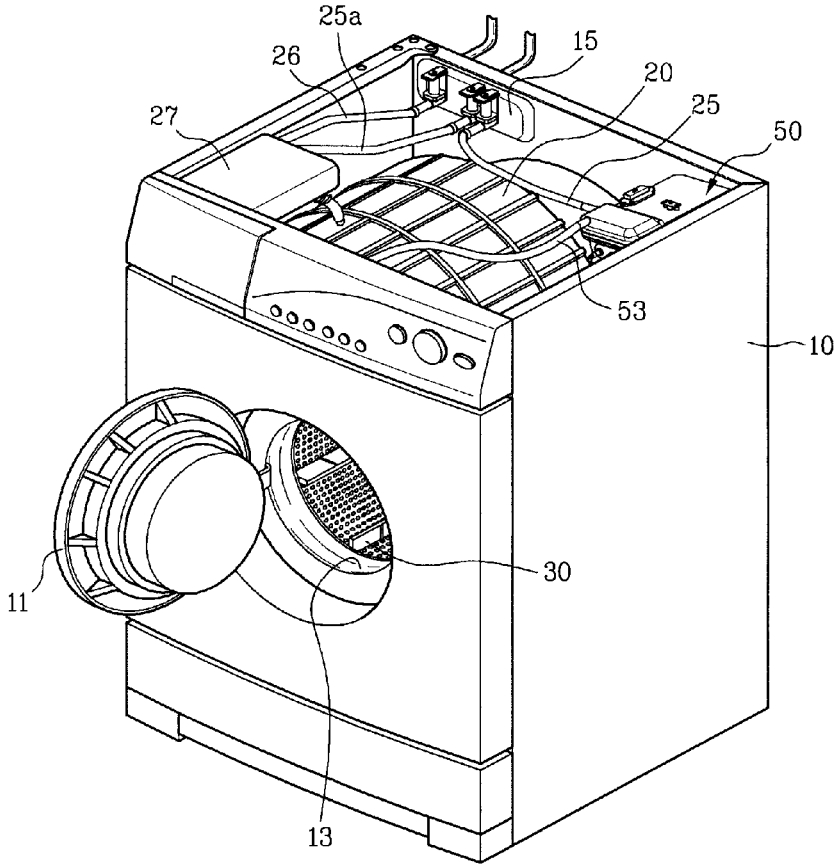
FIG. 1 is a diagram schematically illustrating a drum type laundry machine having a steam generator.

The drum type laundry machine includes a cabinet 10, a tub 20, a drum 30 and a motor (not shown). The cabinet 10 defines an exterior appearance of the drum type laundry machine. The tub 20 has a cylinder shape, horizontally provided in the cabinet 10, and it holds water for washing laundry. The drum 30 is rotatable in the tub 20 and the motor (not shown) drives the drum 30. An opening 13 is formed at a front of the cabinet 10, in communication with the drum 30, and laundry is entered through the opening 13. A door 11 is coupled to the opening to close it. A water supply valve 15 is provided in a predetermined portion of the laundry machine to supply water to the tub 20, being connected with an external water pipe (not shown). Typically, a warm water pipe 25*a* and a cold water pipe 26 are connected between a detergent box 27 and the water supply valve 15 to supply warm and cold water to the detergent box 27.

Here, a steam generator 50 is provided in the drum type laundry machine to supply steam to the tub 20. A water supply hose 25 and a steam hose 53 are connected with the steam generator 50. The water supply hose 25 is connected with the warm water pipe of the water supply valve 15. An end of the steam hose 53 may be nozzle-shaped. The steam hose 53 may be installed at a predetermined position capable of supply steam into the drum 30.

Figure 2:
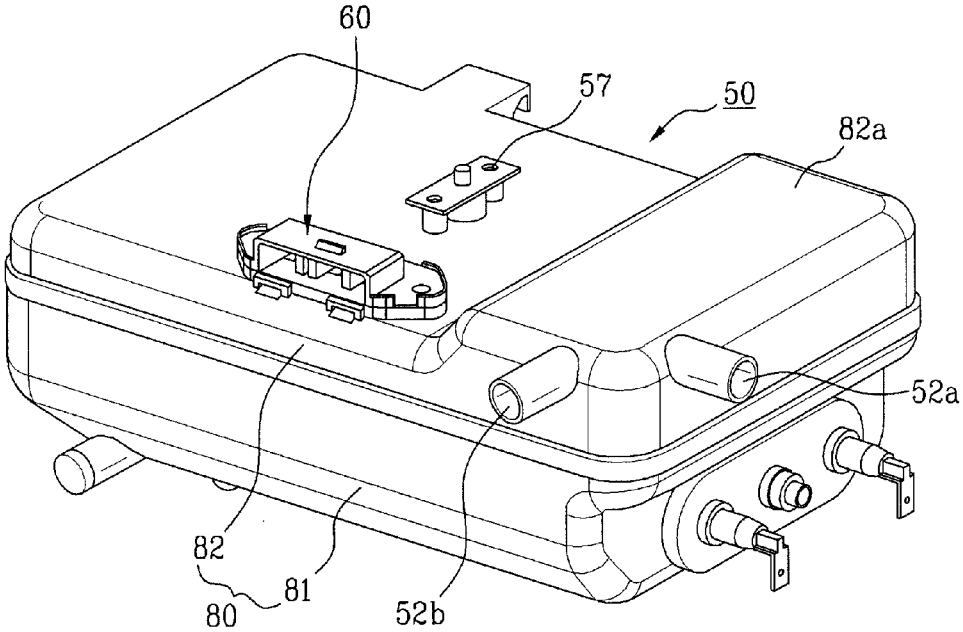
FIGS. 2 and 3 illustrate the steam generator installed in the drum type laundry machine shown in FIG. 1, respectively.

In reference to FIGS. 2 and 3, the structure of the steam generator 50 will be described in detail.

The steam generator 50 includes a lower housing 81, an upper housing 82, and a heater 55. The lower housing 81 defines an exterior appearance of the steam generator 50 and it forms a predetermined space to hold water. The upper housing 82 is coupled to the lower housing 81. The heater 55 heats water held within the steam generator 50.

An inlet 52*a* is formed at a predetermined portion of the upper housing 82, connected with the water supply hose 25, such that water is supplied to the steam generator 50 via the inlet 52*a*. An outlet 52*b* is formed at another predetermined portion of the upper housing 82, connected with the steam hose 53, such that the generated steam may be supplied to the drum 20 via the outlet.

The heater 55 is installed in a lower portion of the lower housing 81. If the water is supplied to the steam generator 50, the heater 55 is operated.

A water level sensor 60 is installed through the upper housing 82 to measure a level of water inside the steam generator 50. If the sensed water level is below a redetermined level, the water supply valve 15 is opened to supplement water to the steam generator 50. And, if the water level is over another predetermined level, the water supply valve 15 is closed and the heater 55 is controlled to be operated to generate the steam.

A temperature sensor 57 is further installed at the upper housing 82 to measure a temperature inside of the steam generator 50. If the sensed temperature is over a predetermined temperature, then the heater 55 is turned off to prevent overheat of the heater 55.

The heater 55 is a heat-variable heater heat output of which can be adjusted. A controller 200 controls the heater 55 to adjust the heat output. For example, if a relatively large amount of steam is required, the controller 200 operates the heater to output relatively large heat and if a relatively small amount of steam is required, the controller 200 operates the heater to output relatively small heat. In other words, the heat output of the heater 55 may be adjusted by the controller 200 according to a required amount of steam. To adjust the heat output, the controller 200 may control an electrical power to be supplied to the heater 55.

Next, the water level sensor 60 will be described in detail.

The water level sensor 60 includes a receptacle housing 61 and a plurality of electrodes 62, 63 and 64. The receptacle housing 61 defines an exterior appearance of the water level sensor 60 and it secured the water level sensor 60 to the steam generator 60. The electrodes 62, 63 and 64 are installed underneath the receptacle housing 61 to sense water levels of the steam generator 50. each of the electrodes 62, 63 and 64 is spaced apart a predetermined distance from a bottom of the lower housing 81.

Figure 4:
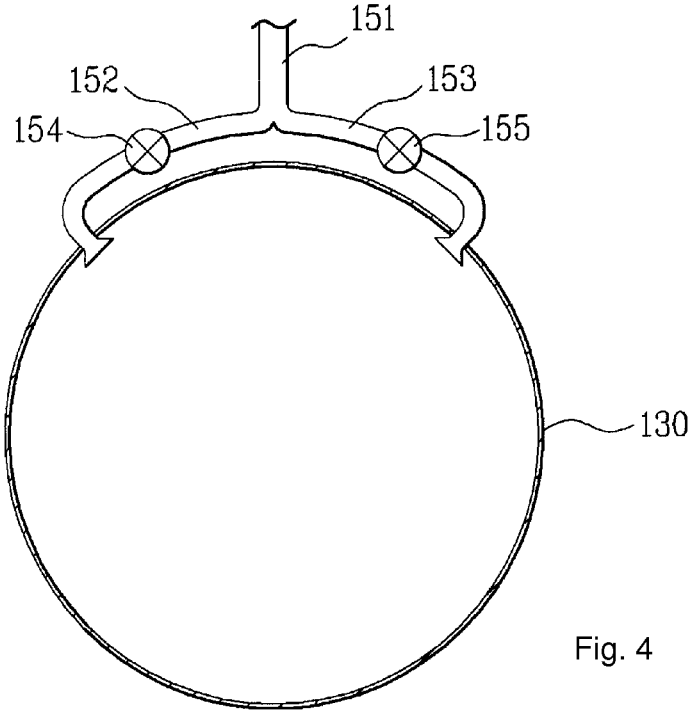
FIGS. 4 to 6 illustrate embodiments of plural steam nozzles.
Figure 5:
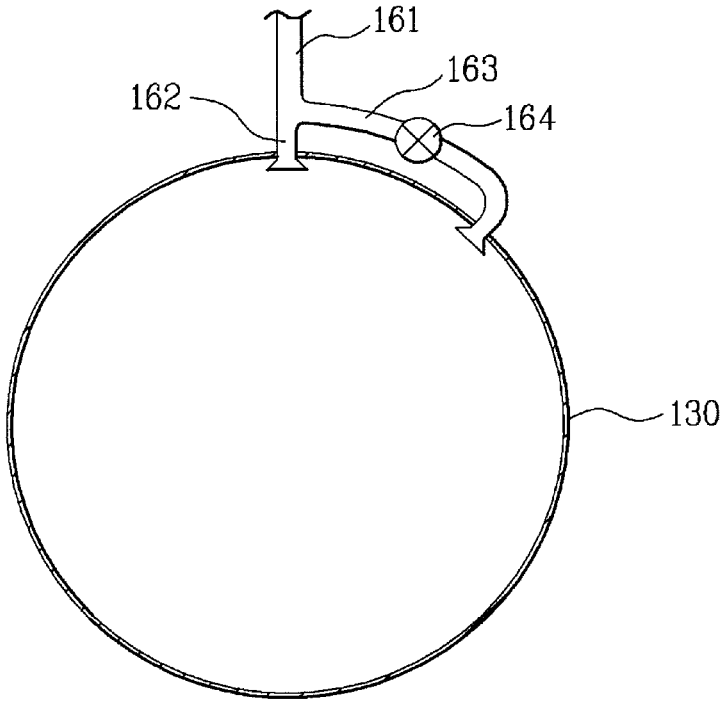
Figure 6:
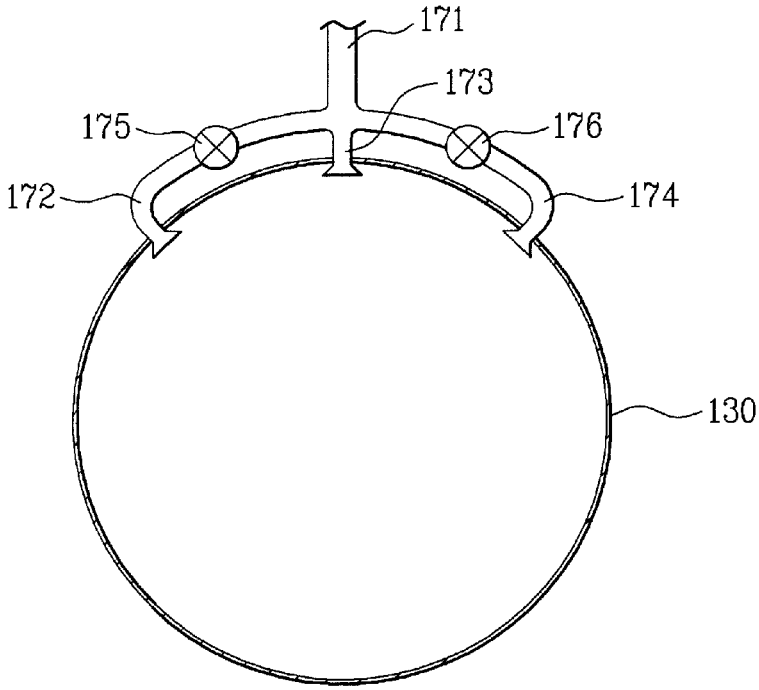

FIGS. 4 to 6 illustrate embodiments in that a plurality of nozzles is provided to spray steam into the drum.

According to an embodiment of FIG. 4, a first steam hose 152 and a second steam hose 153 are branched toward both opposite directions of the drum from a main hose 151 connected with the steam generator. Nozzles are connected to ends of the first and second steam hoses 152 and 153, respectively.

A first valve 154 and a second valve 155 are installed at the first and second steam hoses 152 and 153, respectively.

According to another embodiment of FIG. 5, a first steam hose 162 and a second steam hose 163 are branched from a main hose 161, each end thereof having a nozzle. A nozzle of the first steam hose 161 is positioned at an upper center of the drum 130. Here, a valve 164 is installed only at the second steam hose 163.

According to a still further embodiment of FIG. 6, a first steam hose 172, a second steam hose 173 and a third steam hose 174 are branched from a main hose 171, each end thereof having a nozzle. A nozzle of the second steam hose 173 is positioned at an upper center of the drum 130 and the other nozzles of the steam hoses 172 and 174 are positioned at both opposite sides of the drum 130, respectively.

Here, valves 175 and 176 are installed at the first and third steam hoses 172 and 174, respectively.

In the above embodiment, the controller 200 controls the valves to adjust the amount and the supplying mode or direction of steam supplied to the drum 130.

Figure 7:
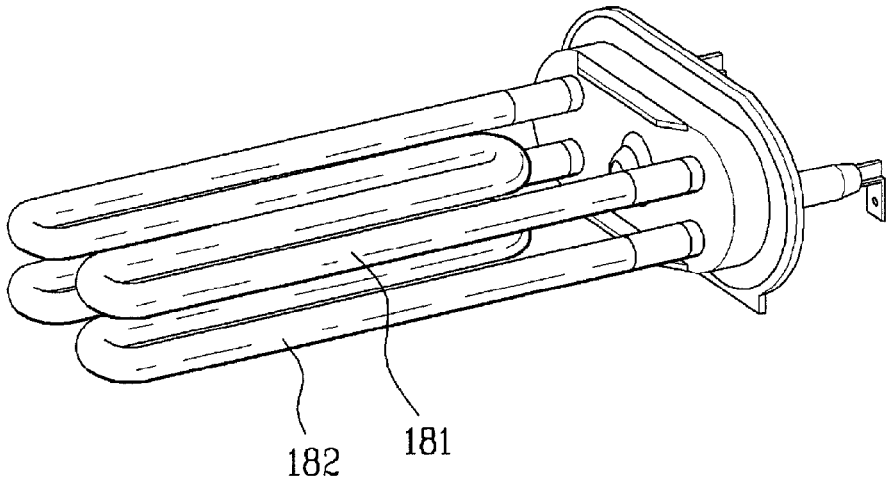
FIG. 7 illustrates another embodiment of a heater provided in a steam generator.
Figure 8:
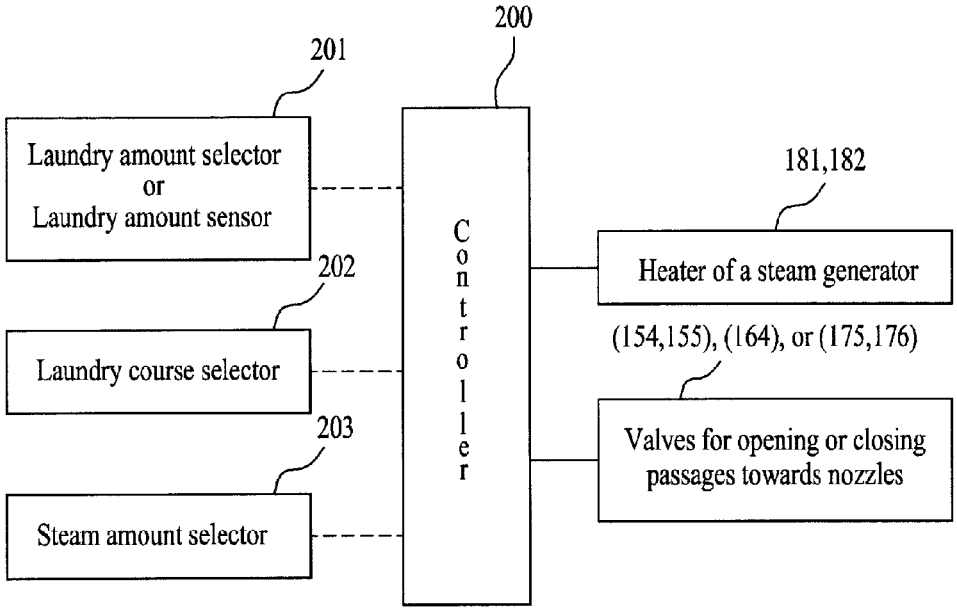
FIG. 8 is a block view illustrating each components controlled by a controller.

FIG. 7 illustrates an embodiment in that two heating elements of the heater are provided in the steam generator. That is, the heater includes a first heating element 181 and a second heating element 182.

As a result, the rate of steam generation is changing according to a case of using either of the first and second heating elements 181 and 182 and a case of using both of them.

If the capacity of the first heating element 181 is different from that of the second heating element 182, the rate of steam generation may be variable in three steps, for example, a case of using only the first heating element 181, a case of using only the second heating element 182 and a case of both the first and second heating elements 181 and 182.

Figure 3:
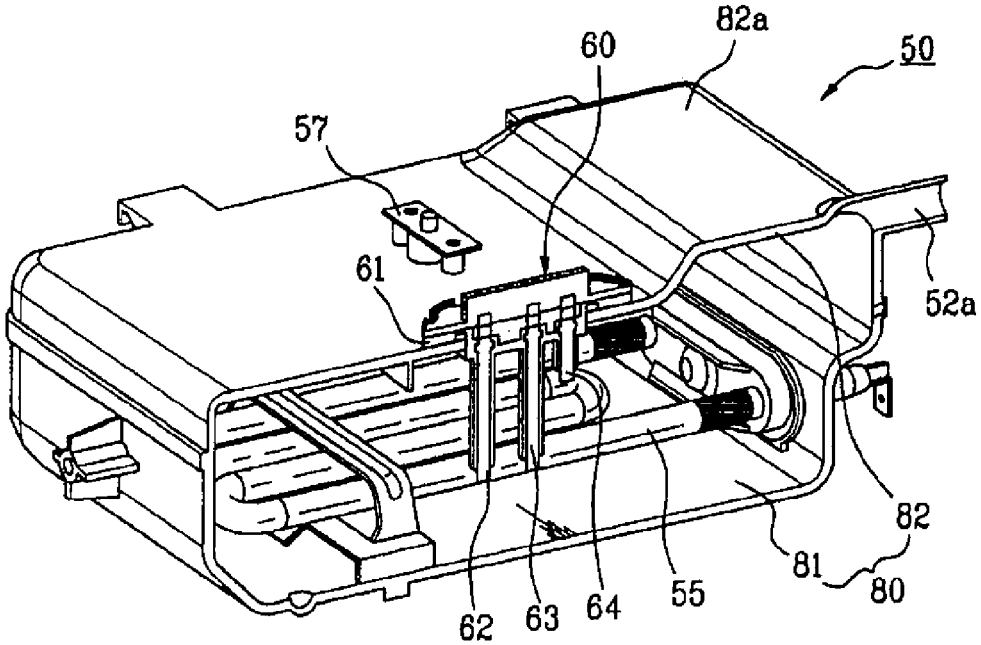

The first heating element 181 or the second heating element 182 may be a heat-variable heater, like the heater 55 shown in FIG. 3. If so, the heat output can be adjustable in more steps.

Meanwhile, the steam generated from the steam generator may be supplied to the drum 130 in various modes shown in FIGS. 4 to 6.

At a control panel shown in FIG. 1 may be installed a steam amount selector 203 for a user to adjust the rate of steam generation.

From now on, it will be exemplified that the first and second heating elements 181 and 182 having different capacities are installed in the steam generator and the steam hoses and nozzles shown in FIG. 6 are adapted. With the heating elements 182 and 183, the steam amount selector 203 may be operated to adjust the steam amount in three steps.

If the user selects "low" of steam amount via the steam amount selector 203, the controller 200 operates only the first heating element 181 of the heaters provided in the steam generator. Here, the valves 175 and 176 installed at the first and third steam hoses 172 and 174 are maintained to be closed.

If the user selects "middle" of steam amount, the controller 200 operates only the second heating element 182. Here, either of the valves 175 and 176 installed at the first and third steam hoses 172 and 174 is opened. The valves 175 and 176 installed at the first and third steam hoses 172 and 174 are alternatively opened in a predetermined time period.

If the user selects "high" of steam amount, the controller operates both the first and second heating elements 181 and 182 to maximize the steam generation rate. Here, all of the valves 175 and 176 installed at the first and third steam hoses 172 and 175 are opened and then the steam is supplied to the drum via all of the first, second and third steam hoses 172, 173 and 174.

The above embodiment presents that the rate of steam supply, that is, the amount of steam supplied to the drum may be adjustable according to a user s selection through the steam amount selector 203. However, the steam generation rate may be adjustable according to a course which uses the steam or the amount of laundry.

Specifically, if a laundry course is selected via a laundry course selector 202, the controller controls the heater (55 or 181 and 182) to generate steam. For example, if there are provided a first laundry course and a second laundry course which requires substantially less steam than the first course and the first course is selected, the controller 200 operates the heater (55 or 181 and 182) to have a high heat amount and the corresponding amount of steam is generated. An operation mode of the heater (55 or 181 and 182) may be preset according to each laundry course. That is, a corresponding heater operation mode may be preset according to each of the laundry courses. As the laundry course is selected, the heater is operated according to preset corresponding heater operation mode. Here, the heater operation modes are classified based on the heat output of the heater.

Next, an embodiment in that an operation mode of heating the heater (55 or 181 and 182) is changing according to the laundry amount will be described.

For example, the laundry amount may be classified into "large," "middle" and "small." If the laundry amount is determined as "large," the heater (55 or 181 and 182) may be controlled to output the maximum amount of heat. If the laundry amount is determined as "small," the heater 55 or 181 and 182 may be controlled to output the minimum amount of heat. If the laundry amount is determined as "middle" the heater 55 or 181 and 182 may be controlled to output the middle amount of heat.

Here, the laundry amount may be determined by a laundry amount sensor provided in the drum type laundry machine or the laundry amount may be determined by a user's selection. For the user's selection, a laundry amount selector 201 may be further provided at the control panel of the drum type laundry machine.

The steam amount selector 203 or the laundry amount selector 201 may be provided in a button or touch screen type. Of course, the steam amount selector 203 or the laundry amount selector 201 may be provided in other various types.

Even though it is not shown in the Figs, the laundry machine may include means for allowing a user to input a command for supplying steam to the tub or the drum at any time which he/she wants. The means may comprise a button, a touch panel, or other forms allowing the inputting of the command.

Whenever the user inputs the command through the means, the controller of the laundry machine may instantly response to the command. So, the controller controls the steam generator to be operated to supply steam to the tub or the drum.

The user may input the command at any time he/she wants, even during a laundry course being performed. For example, the user may input the command for the supplying of steam while a washing cycle, a rinsing cycle, or a spin-drying cycle is being performed.

Further, the laundry machine may include a displaying means for indicating that steam is being supplied to the tub or the drum. A user may easily recognize that steam is being discharged into the tub or the drum.

Further, the laundry machine may include a displaying means for indicating the generated or supplied amount of steam per time. The means may indicate a rate of the generation or supply of the steam. The amount of steam which is generated or supplied per time may differ according to the heat setting of the heater. The means may indicate the amount of steam per time.

The displaying means for the indications as above may comprises LED lamps or a LCD display.

Figure 9:
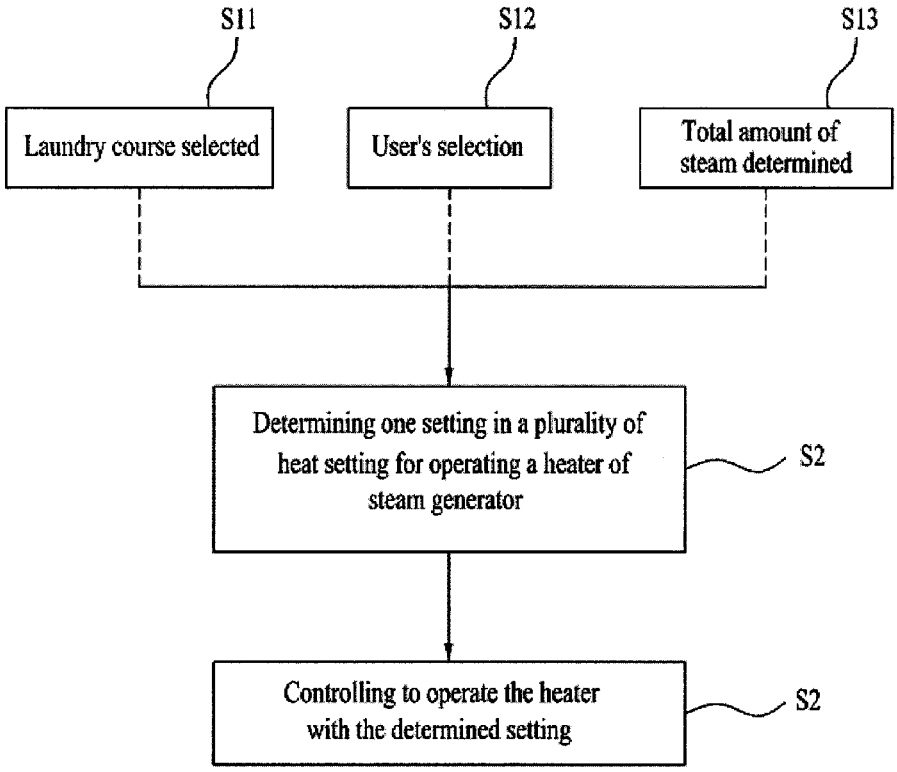
FIG. 9 illustrates an exemplary embodiment of a controlling method of the laundry machine.

FIG. 9 illustrates an exemplary embodiment of a controlling method of the laundry machine.

As shown in FIG. 9, the controller determines one of heat settings to operate the heater of the steam generator (S2).

Hence, the controller controls and operates the heater according to the determined setting (S3).

Here, the heat setting is determined in consideration of the selected laundry course (S11) or the user's selection (S12) or the total determined steam amount (S13).

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

INDUSTRIAL APPLICABILITY

The disclosure relates to a laundry machine, and more particularly, to a laundry machine having a steam generator. In a disclosed laundry machine, The steam is generated and supplied to a tub or a drum with different rates according to a condition.

The invention claimed is:

1. A laundry machine comprising:

a drum in which laundry is placed and treated;

a steam generator to generate steam to be supplied to the drum, the steam generator including a heat-variable heater heat output of which can be adjusted;

a plurality of nozzles in flow communication with the steam generator, the nozzles provided to spray steam into the drum;

a plurality of valves provided upstream of the plurality of nozzles to control supplying of the steam into the drum; and a controller to control the heater to generate the steam in a predetermined amount, wherein the heater includes a first heating element and a second heating element, wherein a capacity of the first heating element is different from that of the second heating element, and wherein the controller controls the plurality of valves according to the operation of the first heating elements and the second heating elements.

2. The laundry machine claimed in claim 1, wherein the controller controls the heater to generate the steam in the predetermined amount per time.

3. The laundry machine claimed in claim 1, wherein the predetermined amount of steam is determined according to at least one of a laundry course, a user's selection, and a total amount of steam which is to be supplied to the drum.

4. The laundry machine claimed in claim 3, further comprising a steam amount selector to allow a user to select an amount of steam to be supplied to the drum.

5. The laundry machine claimed in claim 4, wherein the steam amount selector is configured to allow the user to select one among a plurality of predetermined settings.

6. The laundry machine claimed in claim 3, wherein the total amount of steam is determined according to an amount of the laundry.

7. The laundry machine claimed in claim 6, further comprising a laundry amount sensor to sense an amount of laundry or a laundry amount selector to allow a user to select an amount of laundry.

8. The laundry machine claimed in claim 1, further comprising one or more valves to open or close one or more steam passage for the nozzles.

9. The laundry machine claimed in claim 8, the one or more valves are alternatively opened in a predetermined time period.

10. The laundry machine claims in claim 1, wherein the plurality of heating elements have different capacity.

11. A laundry machine comprising:

a drum in which laundry is placed and treated;

a steam generator to generate steam to be supplied to the drum, the steam generator including a heater which is operated in a plurality of heat settings and heat output of which can be adjusted;

a plurality of nozzles in flow communication with the steam generator, the nozzles provided to spray steam into the drum;

a plurality of valves provided upstream of the plurality of nozzles to control supplying of the steam into the drum; and a controller to control the heater to be operated in one setting in the plurality of heat settings, wherein the one setting is determined according to at least one of a laundry course, a user's selection, and a total amount of steam which is to be supplied to the drum, wherein the heater includes a first heating element and a second heating element, wherein a capacity of the first heating element is different from that of the second heating element, and wherein the controller controls the plurality of valves according to the operation of the first heating element and the second heating element.

12. The laundry machine claimed in claim 11, further comprising a steam amount selector to allow a user to select an amount of steam to be supplied to the drum.

13. The laundry machine claimed in claim 12, wherein the steam amount selector is configured to allow the user to select one among a plurality of predetermined settings.

14. The laundry machine claimed in claim 11, wherein the total amount of steam is determined according to an amount of the laundry.

15. The laundry machine claimed in claim 14, further comprising a laundry amount sensor to sense an amount of laundry or a laundry amount selector to allow a user to select an amount of laundry.

16. The laundry machine claimed in claim 11, further comprising one or more valves to open or close one or more steam passages for the nozzles.

17. The laundry machine claimed in claim 16, the one or more valves are alternatively opened in a predetermined time period.

* * * * *